United States Patent [19]

Goto et al.

[11] Patent Number: 5,063,197

[45] Date of Patent: Nov. 5, 1991

[54] HEAT-SENSITIVE RECORDING MATERIAL

[75] Inventors: Atsuo Goto; Fumio Okumura, both of Tsukuba; Kazuhiko Ito, Tsuchiura, all of Japan

[73] Assignee: Mitsubishi Paper Mills Limited, Tokyo, Japan

[21] Appl. No.: 576,969

[22] Filed: Sep. 4, 1990

[30] Foreign Application Priority Data

| | | | |
|---|---|---|---|
| Sep. 4, 1989 | [JP] | Japan | 1-230084 |
| Sep. 29, 1989 | [JP] | Japan | 1-254618 |
| Nov. 17, 1989 | [JP] | Japan | 1-299072 |
| Feb. 9, 1990 | [JP] | Japan | 2-30556 |
| Feb. 9, 1990 | [JP] | Japan | 2-30557 |
| Mar. 27, 1990 | [JP] | Japan | 2-79643 |
| May 7, 1990 | [JP] | Japan | 2-118242 |
| May 7, 1990 | [JP] | Japan | 2-118243 |

[51] Int. Cl.[5] ..... B41M 5/30

[52] U.S. Cl. ..... 503/209; 503/208; 503/225

[58] Field of Search ..... 427/150–152; 503/208, 209, 225

[56] References Cited

FOREIGN PATENT DOCUMENTS 0361463 4/1990 European Pat. Off. ..... 503/209

OTHER PUBLICATIONS

Derwent-Abstract 88-192923/28 of the JP-OS 128978, 6/1/88.

*Primary Examiner*—Pamela R. Schwartz

*Attorney, Agent, or Firm*—Cushman, Darby & Cushman

[57] ABSTRACT

A heat-sensitive recording material comprising a support and a heat-sensitive recording layer provided on the support, said heat-sensitive recording layer comprising an electron-donating, colorless or pale-colored dye precursor, an electron-accepting developer which reacts with the dye precursor to form images upon heating, a binder, and a specific aromatic compound. The heat-sensitive recording material has an excellent heat responsiveness, and hence recorded images having a sufficient optical density can be printed even with low energy.

17 Claims, No Drawings

HEAT-SENSITIVE RECORDING MATERIAL

This invention relates to a heat-sensitive recording material. More particularly, this invention relates to a heat-sensitive recording material excellent in heat responsiveness.

Generally, heat-sensitive recording materials comprise a support having provided thereon a heat-sensitive recording layer comprising, as essential components, an electron-donating dye precursor which is generally colorless or pale-colored and an electron-accepting developer. Upon heating the heat-sensitive recording material by a thermal head, a thermal pen, a laser beam, or the like, the dye precursor and the developer instantly reacts with each other to give recorded images. Such heat-sensitive recording materials are disclosed in Japanese Pat. Appln. Kokoku Nos. S.43-4160 and S.45-14039 and the like.

When such heat-sensitive recording materials are used, records can be obtained by a relatively simple apparatus, the maintenance of the apparatus is easy, and it is quiet. Thus, the heat-sensitive recording materials are used in a wide variety of fields such as measuring recorders, facsimiles, printers, terminals of computers, labels, ticket vending machines, and the like. Particularly, the demand for heat-sensitive recording materials has greatly increased in the field of facsimiles. In this field, attempts have been made for the purpose of speed-up of recording in order to reduce transmission cost, miniaturization of facsimile machines, and reducing the price thereof. As a result, applied energy for forming images has been greatly reduced recently. Therefore, it has been strongly desired to develop a heat-sensitive recording material having high sensitivity and sufficient heat responsiveness in order to meet these requirements (i.e. miniaturization of facsimile machines, reduction of applied energy for forming images, etc.). In a high speed recording, it is required that a small amount of thermal energy emitted from a thermal head for quite short period (generally 1 msec or less) be effectively used for the coloring reaction to form colored images having high density.

In order to attain the above object, it has been suggested that a heat-meltable substance having relatively low melting point is used as a sensitizer along with a dye precursor and an electron-accepting compound which reacts with the dye precursor to form images. As the sensitizer, there are disclosed, for example, naphthol derivatives in Japanese Pat. Appln. Kokai Nos. S.57-64593 and S.58-87094; naphthoic acid derivatives in Japanese Pat. Appln. Kokai Nos. S.57-64592, S.57-185187, S.57-191089, S.58-110289, and S.59-15393; ether or ester derivatives of phenol compounds in Japanese Pat. Appln. Kokai Nos. S 58-72499, and S.58-87088.

However, heat-sensitive recording materials containing the above compound are not sufficient in heat responsiveness, recording sensitivity and the like.

Furthermore, Japanese Pat. Appln. Kokai No. S.63-128978 discloses a recording material comprising an aromatic ether or thioether compound such as 2-(p-phenyl-phenoxymethyl)-1,3-dioxolane. However, in case of such a recording material, there cannot be obtained recorded images sufficient in stability (causing discoloration hardly) and in saturated optical density.

It is an object of this invention to obtain a heat-sensitive recording material excellent in heat-responsiveness, recording sensitivity and the like.

According to this invention, there is provided a heat-sensitive recording material comprising a support and a heat-sensitive recording layer provided on the support, the heat-sensitive recording layer comprises a dye precursor, a developer, a binder, and an aromatic compound represented by the following structural formula:

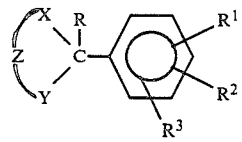

[I]

wherein

X and Y are oxygen atoms or sulfur atoms and may or may not be identical with each other, Z is alkylene group which has two or more carbon atoms and may have a side chain, R is hydrogen atom or alkyl group, $R^1$, $R^2$ and $R^3$ are independently hydrogen atoms;

alkoxy groups;

alkylthio groups;

phenyl groups;

aryloxy groups which may have a substituent;

—$COOR^4$ groups wherein $R^4$ is alkyl group or aralkyl or aryl group which may have a substituent; or —$OZ^1X^1$—$Ar^1$ groups wherein $Z^1$ is alkylene or alkenylene group which may have a substituent, $X^1$ is oxygen atom, sulfur atom, or single bond and $Ar^1$ is aryl group which may have a substituent;

and wherein all of $R^1$, $R^2$ and $R^3$ are not hydrogen atoms and two of $R^1$, $R^2$ and $R^3$ may be linked with each other to form a cyclic structure.

This invention is explained in detail below.

The heat-sensitive recording material of this invention comprises a support and a heat-sensitive recording layer provided on the support.

The heat-sensitive recording layer contains a dye precursor, a developer, a binder, and a specific aromatic compound as essential components.

From the overall viewpoint of the sensitivity, image stability, ease of synthesizing the aromatic compound, prevention of stains from adhering to a thermal head, and the like, it is preferable that $R^1$ and $R^2$ be hydrogen atoms and $R^3$ be —$OZ^1X^1$—$Ar^1$ group wherein $Z^1$ is alkylene group having 1–4 carbon atoms (preferably methylene group or ethylene group), and $X^1$ is oxygen atom or a single bond. In addition to the above, it is more preferable that $R^3$ bond to 4-position of the benzene ring, R be hydrogen atom or methyl group, and Z be ethylene group.

In this invention, it is preferable that the aromatic compound have a melting point of 60°–160° C. in view of practical use for a heat-sensitive recording material.

In the first aspect of this invention, the aromatic compound is prescribed by that R, $R^1$ and $R^2$ are hydrogen atoms, $R^3$ is —$OZ^1$—$Ar^1$ group bonding to 4-position of the benzene ring, and $Z^1$ is methylene group. That is, the aromatic compound is represented by the structural formula [II]:

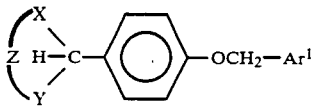

[II]

wherein X and Y are independently oxygen or sulfur atoms, Z is alkylene group which has two or more carbon atoms and may have alkyl group as a side chain, and $Ar^1$ is a substituted or unsubstituted aryl group.

The substituent of the aryl group includes halogen atom, alkyl group, alkylthio group, alkenyl group, alkoxy group, aralkyl group, aralkyloxy group, nitro group, cyano group, and the like; however, it is not restricted to them. Furthermore, these substituents may have a substituent.

As the aromatic compound used in the first aspect of this invention, the following compounds may be mentioned. These examples are to be considered as illustrative and not restrictive.

(1) 2-(4-benzyloxyphenyl)-1,3-dioxane
(2) 2-(4-benzyloxyphenyl)-1,3-dithiane
(3) 2-(4-benzyloxyphenyl)-1,3-dithiolane
(4) 4,5-dimethyl-2-(4-benzyloxyphenyl)-1,3-dithiolane
(5) 2-[4-(4-methylbenzyloxy)phenyl]-1,3-dioxane
(6) 2-[4-(4-methylbenzyloxy)phenyl]-1,3-dioxolane
(7) 2-[4-(4-methylbenzyloxy)phenyl]-1,3-dithiane
(8) 2-[4-(4-methylbenzyloxy)phenyl]-1,3-dithiolane
(9) 2-[4-(4-methylbenzyloxy)phenyl]-1,3-oxathiolane
(10) 4,6-dimethyl-2-[4-(4-methylbenzyloxy)phenyl)]-1,3-dioxane
(11) 4-methyl-2-[4-(4-methylbenzyloxy)phenyl]-1,3-dithiolane
(12) 4,5-dimethyl-2-[4-(4-methylbenzyloxy)phenyl)]-1,3-dithiolane
(13) 2-[4-(3-methylbenzyloxy)phenyl]-1,3-dioxane
(14) 2-[4-(3-methylbenzyloxy)phenyl]-1,3-dithiane
(15) 2-[4-(3-methylbenzyloxy)phenyl]-1,3-dithiolane
(16) 4,5-dimethyl-2-[4-(3-methylbenzyloxy)phenyl-1,3-dithiolane
(17) 2-[4-(2-methylbenzyloxy)phenyl]-1,3-dithiane
(18) 2-[4-(2-methylbenzyloxy)phenyl]-1,3-dithiolane
(19) 2-[4-(4-methoxybenzyloxy)phenyl]-1,3-dioxane
(20) 2-[4-(4-methoxybenzyloxy)phenyl]-1,3-dithiane
(21) 2-[4-(4-methoxybenzyloxy)phenyl]-1,3-dithiolane
(22) 4,5-dimethyl-2-[4-(4-methoxybenzyloxy)phenyl]-1,3-dithiolane
(23) 2-[4-(3-methoxybenzyloxy)phenyl]-1,3-dithiane
(24) 2-[4-(3-methoxybenzyloxy)phenyl]-1,3-dithiolane
(25) 2-[4-(4-chlorobenzyloxy)phenyl]-1,3-dioxane
(26) 2-[4-(4-chlorobenzyloxy)phenyl]-1,3-dithiane
(27) 2-[4-(4-chlorobenzyloxy)phenyl]-1,3-dithiolane
(28) 2-[4-(4-chlorobenzyloxy)phenyl]-1,3-oxathiolane
(29) 4-methyl-2-[4-(4-chlorobenzyloxy)phenyl]-1,3-dithiolane
(30) 4,5-dimethyl-2-[4-(4-chlorobenzyloxy)phenyl]-1,3-dithiolane
(31) 2-[4-(3-chlorobenzyloxy)phenyl]-1,3-dithiane
(32) 2-[4-(3-chlorobenzyloxy)phenyl]-1,3-dithiolane
(33) 2-[4-(2-chlorbenzyloxy)phenyl]-1,3-dithiane
(34) 2-[4-(2-chlorobenzyloxy)phenyl]-1,3-dithiolane
(35) 2-[4-(2,4-dimethylbenzyloxy)phenyl]-1,3-dithiane
(36) 2-[4-(2,4-dimethylbenzyloxy)phenyl]-1,3-dithiolane
(37) 2-[4-(3,4-dimethylbenzyloxy)phenyl]-1,3-dithiane
(38) 2-[4-(3,4-dimethylbenzyloxy)phenyl]-1,3-dithiolane
(39) 2-[4-(2,4-dichlorobenzyloxy)phenyl]-1,3-dithiane
(40) 2-[4-(2,4-dichlorobenzyloxy)phenyl]-1,3-dithiolane
(41) 2-[4-(2,6-dichlorobenzyloxy)phenyl]-1,3-dithiane
(42) 2-[4-(2,6-dichlorobenzyloxy)phenyl]-1,3-dithiolane
(43) 2-[4-(4-ethylbenzyloxy)phenyl]-1,3-dioxane
(44) 2-[4-(4-ethylbenzyloxy)phenyl]-1,3-dithiane
(45) 2-[4-(4-ethylbenzyloxy)phenyl]-1,3-dithiolane
(46) 2-[4-(4-isopropylbenzyloxy)phenyl]-1,3-dithiane
(47) 2-[4-(4-isopropylbenzyloxy)phenyl]-1,3-dithiolane
(48) 2-[4-(4-methylthiobenzyloxy)phenyl]-1,3-dioxane
(49) 2-[4-(4-methylthiobenzyloxy)phenyl]-1,3-dithiane
(50) 2-[4-(4-methylthiobenzyloxy)phenyl-1,3-dithiolane
(51) 4,5-dimethyl-2-[4-(4-methylthiobenzyloxy)phenyl]-1,3-dithiolane
(52) 2-[4-(3-methylthiobenzyloxy)phenyl]-1,3-dithiane
(53) 2-[4-(3-methylthiobenzyloxy)phenyl]-1,3-dithiolane
(54) 2-[4-(1-naphthylmethoxy)phenyl]-1,3-dioxane
(55) 2-[4-(1-naphthylmethoxy)phenyl]-1,3-dithiane
(56) 2-[4-(1-naphthylmethoxy)phenyl-1,3-dithiolane
(57) 2-[4-(4-nitrobenzyloxy)phenyl]-1,3-dioxane
(58) 2-[4-(4-nitrobenzyloxy)phenyl]-1,3-dioxolane
(59) 2-[4-(4-nitrobenzyloxy)phenyl]-1,3-dithiolane
(60) 2-[4-(4-nitrobenzyloxy)phenyl]-1,3-oxathiolane
(61) 2-[4-(3-nitrobenzyloxy)phenyl]-1,3-dioxane
(62) 2-[4-(3-nitrobenzyloxy)phenyl]-1,3-dithiane
(63) 2-[4-(3-nitrobenzyloxy)phenyl)-1,3-dithiolane
(64) 2-[4-(2-nitrobenzyloxy)phenyl]-1,3-dioxane
(65) 2-[4-(2-nitrobenzyloxy)phenyl]-1,3-dithiane
(66) 2-[4-(2-nitrobenzyloxy)phenyl]-1,3-dithiolane
(67) 2-[4-(4-cyanobenzyloxy)phenyl]-1,3-dioxane
(68) 2-[4-(4-cyanobenzyloxy)phenyl]-1,3-dioxolane
(69) 2-[4-(4-cyanobenzyloxy)phenyl]-1,3-dithiolane
(70) 2-[4-(4-cyanobenzyloxy)phenyl]-1,3-oxathiolane
(71) 2-[4-(3-cyanobenzyloxy)phenyl]-1,3-dioxane
(72) 2-[4-(3-cyanobenzyloxy)phenyl]-1,3-dithiane
(73) 2-[4-(3-cyanobenzyloxy)phenyl]-1,3-dithiolane
(74) 2-[4-(2-cyanobenzyloxy)phenyl]-1,3-dioxane
(75) 2-[4-(2-cyanobenzyloxy)phenyl]-1,3-dithiane
(76) 2-[4-(2-cyanobenzyloxy)phenyl]-1,3-dithiolane
(77) 2-[4-(4-vinylbenzyloxy)phenyl]-1,3-dioxane
(78) 2-[4-(4-vinylbenzyloxy)phenyl]-1,3-dioxolane
(79) 2-[4-(4-vinylbenzyloxy)phenyl]-1,3-dithiolane
(80) 2-[4-(4-vinylbenzyloxy)phenyl]-1,3-oxathiolane
(81) 2-[4-(4-benzylbenzyloxy)phenyl]-1,3 dioxane
(82) 2-[4-(4-benzylbenzyloxy)phenyl]-1,3-dithiolane
(83) 2-[4-(4-benzylbenzyloxy)phenyl]-1,3-dithiolane
(84) 2-[4-(4-benzyloxybenzyloxy)phenyl]-1,3-dioxane
(85) 2-[4-(4-benzyloxybenzyloxy)phenyl]-1,3-dithiane
(86) 2-[4-(4-benzyloxybenzyloxy)phenyl]-1,3 dithiolane
(87) 2-[4-(4-benzyloxybenzyloxy)phenyl]-1,3-oxathiolane
(88) 4-methyl-2-[4-(4-benzyloxybenzyloxy)phenyl]-1,3-dithiolane
(89) 4,5-dimethyl-2-[4-(4-benzyloxybenzyloxy)phenyl]-1,3-dithiolane
(90) 2-{4-[4-(3-chlorobenzyloxy)benzyloxy]phenyl}-1,3-dithiane
(91) 2-{4-[4-(2-chlorobenzyloxy)benzyloxy]phenyl}-1,3-dithiane The aromatic compound used in the first aspect of this invention can be easily synthesized by a conventional method or the like. For example, 4-hydroxy-benzaldehyde is reacted with a diol such as propanediol or a dithiol such as ethanedithiol, generally with use of an acid catalyst, to obtain a cyclic acetal or a cyclic dithioacetal. Generally, when a diol is used, the reaction is carried out while water is removed. And then, the desired compound can be prepared by reacting the cyclic acetal or cyclic dithioacetal thus obtained with e.g.

benzyl bromide in the presence of an alkali. Alternatively, 4-hydroxybenzaldehyde is reacted with e.g. benzyl bromide in the presence of an alkali, and then the reaction product is acetalized or thioacetalized as described above to obtain the desired compound.

Synthesis Examples of some compounds used in the first aspect of this invention are specifically described below. These Examples are to be considered as illustrative and not restrictive.

SYNTHESIS EXAMPLE 1 Synthesis of 2-(4-benzyloxyphenyl)-1,3-dioxane (compound 1)

10.6 g of 4-benzyloxybenzaldehyde is dissolved in 150 ml of benzene, and then 4.2 g of 1,3-propanediol and about 0.5 g of p-toluenesulfonic acid (monohydrate) are added thereto. The resulting mixture is refluxed for 3 hours while produced water is removed as an azeotrope with benzene. The reaction mixture is washed with 10% aqueous solution of sodium carbonate, and then dried with anhydrous sodium sulfate and benzene is distilled away. The resulting residue is recrystallized from a 10-1 n-hexane-benzene solvent mixture to obtain 7.2 g of the objective compound in the form of white crystal. Thus obtained compound has a melting point of 88.5°-89.5° C.

SYNTHESIS EXAMPLE 2 Synthesis of 2-[4-(4-methyl-benzyloxy)phenyl]-1,3-oxathiolane (compound 9)

18.3 g of p-hydroxybenzaldehyde is dissolved in 200 ml of methyl ethyl ketone, and then 22.8 g of potassium carbonate and 23.2 g of α-chloro-p-xylene are added thereto. The resulting mixture is refluxed for 10 hours in a stream of nitrogen. Insoluble substances produced are removed by filtration, and then the solvent is distilled away. The resulting residue is distilled under reduced pressure to obtain 17.9 g of 4-(4-methylbenzyloxy)benzaldehyde in the form of white crystal.

7.9 g of 4-(4-methylbenzyloxy)benzaldehyde obtained above is dissolved in 100 ml of benzene, and then 2.7 g of 2-mercaptoethanol and about 0.5 g of p-toluenesulfonic acid are added thereto. The resulting mixture is refluxed for 3 hours while produced water is removed as an azeotrope with benzene. The reaction mixture is washed with 10% aqueous solution of sodium carbonate, and then dried with anhydrous sodium sulfate and benzene is distilled away. The resulting residue is recrystallized from 10-1 n-hexane-benzene solvent mixture to obtain 5.0 g of the objective compound in the form of white crystal. Thus obtained compound has a melting point of 101°-102° C.

SYNTHESIS EXAMPLE 3 Synthesis of 2-[4-(3-chloro-benzyloxy)phenyl]-1,3-dithiolane (compound 32)

18.3 g of p-hydroxybenzaldehyde is dissolved in 200 ml of methyl ethyl ketone, and then 22.8 g of potassium carbonate and 24.2 g of m-chlorobenzyl chloride are added thereto. The resulting mixture is refluxed for 8 hours in a stream of nitrogen. Insoluble substances produced are removed by filtration, and then the solvent is distilled away. The resulting residue is distilled under reduced pressure to obtain 32.6 g of 4-(3-chlorobenzyloxy)benzaldehyde in the form of white crystal.

9.9 g of 4-(3-chlorbenzyloxy)benzaldehyde obtained above is dissolved in 150 ml of ethanol and 3.8 g of ethanedithiol is added thereto. Cooling with ice, about 1 g of boron trifluoride ethyl etherate is added dropwise to the resulting mixture with stirring. Instantly, white crystal is precipitated. The mixture is further stirred at room temperature for 1 hour. After that, the crystal is separated by filtration and washed enough with a 10% aqueous solution of sodium carbonate, and then with water. The crystal is dried and recrystallized from ethanol to obtain 8.0 g of the objective compound in the form of white crystal. Thus obtained compound has a melting point of 99°-100° C.

In the second aspect of this invention, the aromatic compound is prescribed by that X and Y are identical with each other, R, $R^1$ and $R^2$ are hydrogen atoms, and $R^3$ is phenyl group bonding to 4-position of the benzene ring. That is, the aromatic compound is represented by the structural formula [III]:

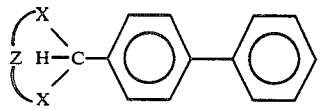

[III]

wherein X is oxygen or sulfur atom, and Z is alkylene group which has two or more carbon atoms and may have alkyl group as a side chain.

As the aromatic compound used in the second aspect of this invention, the following compounds may be mentioned. These examples are to be considered as illustrative and not restrictive.

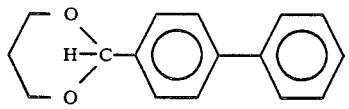

(92)

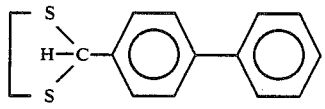

(93)

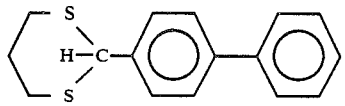

(94)

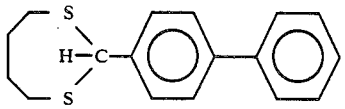

(95)

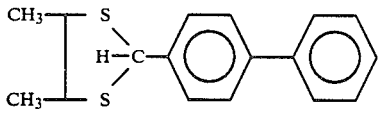

(96)

Incidentally, a heat-sensitive recording material excellent in heat responsiveness can be obtained whether X of the above formula is oxygen or sulfur atom. However, when X is sulfur atom, heat responsiveness becomes especially high.

The aromatic compound used in the second aspect of this invention can be easily prepared by a conventional method or the like. For example, 4-phenylbenzaldehyde is reacted with a diol such as propanediol or a dithiol such as ethanedithiol, generally with use of an acid catalyst, to obtain a cyclic acetal or cyclic dithioacetal. Generally, when diol is used, the reaction is carried out while water is removed.

In the third aspect of this invention, the aromatic compound is prescribed by that R, $R^1$ and $R^2$ are hydrogen atoms, $R^3$ is —$COOR^4$ group. That is, the aromatic compound is represented by the structural formula [IV]:

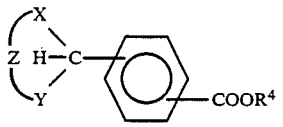

[IV]

wherein X and Y are independently oxygen or sulfur atoms, Z is alkylene group which has two or more carbon atoms and may have alkyl group as a side chain, and $R^4$ is alkyl group; aralkyl group wherein the benzene ring may be substituted by halogen atom, alkyl group, or alkoxy group; or aryl group wherein the benzene ring may be substituted by a halogen atom, alkyl group, or alkoxy group.

As the aromatic compound used in the third aspect of this invention, the following compounds may be mentioned. These examples are to be considered as illustrative and not restrictive.

(97)

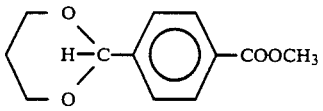

(98)

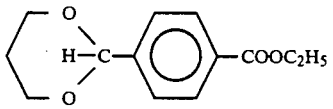

(99)

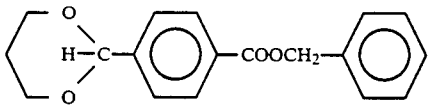

(100)

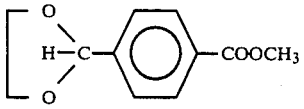

(101)

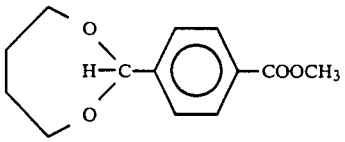

(102)

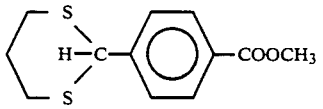

(103)

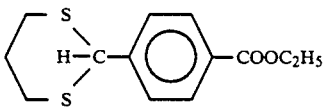

-continued (104)

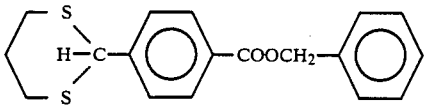

(105)

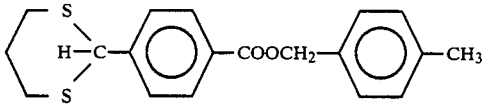

(106)

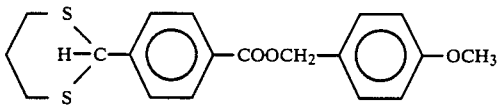

(107)

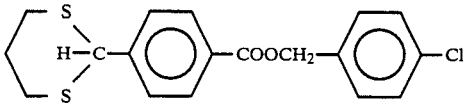

(108)

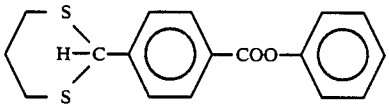

(109)

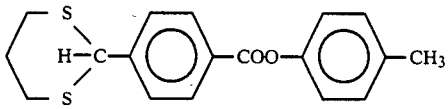

(110)

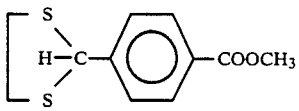

(111)

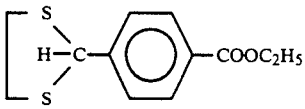

(112)

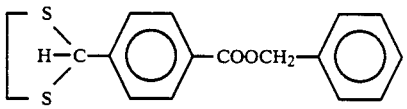

(113)

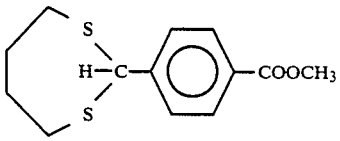

(114)

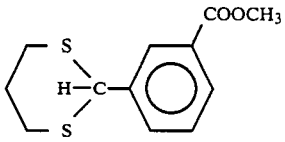

(115)

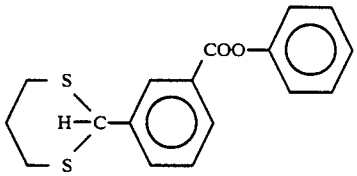

-continued (116)

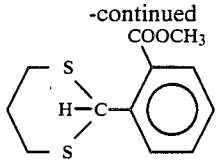

(117)

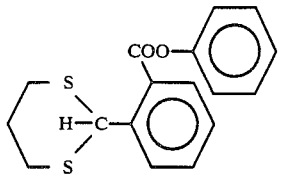

(118)

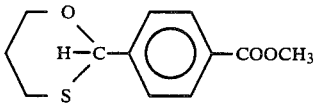

(119)

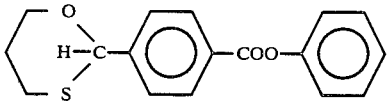

(120)

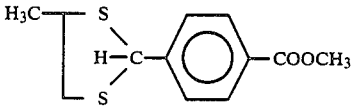

(121)

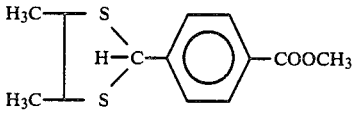

The aromatic compound used in the third aspect of this invention can be easily prepared by a conventional method. For example, terephthalaldehydric acid or methyl terephthalaldehydate is reacted with a diol such as propanediol or a dithiol such as ethanedithiol, generally with use of an acid catalyst, to obtain a cyclic acetal or cyclic dithioacetal. Generally, when diol is used, the reaction is carried out while water is removed. Furthermore, the objective compound can be obtained by a conventional esterification, transesterification, or the like.

In the fourth aspect of this invention, the aromatic compound is prescribed by that R is hydrogen atom and $R^3$ bonds to other than 4-position of the benzene ring when $R^1$ and $R^2$ are hydrogen atoms. That is, the aromatic compound is represented by the structural formula [V]:

[V]

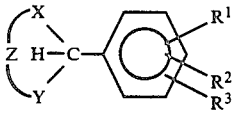

wherein X and Y are independently oxygen or sulfur atoms and may or may not be identical with each other, Z is alkylene group which has two or more carbon atoms and may have alkyl group as side chain, and $R^{1,2}$ and $R^3$ are hydrogen atoms, alkoxy groups, alkylthio groups or aralkyloxy groups which may have a substituent, all of $R^1$, $R^2$ and $R^3$ are not hydrogen atoms at the same time, and when two of $R^1$, $R^2$ and $R^3$ are hydrogen atoms and the other is aralkyloxy group, the aralkyloxy group bonds to other than 4-positions of the benzene ring.

As the aromatic compound used in the fourth aspect of this invention, the following compounds may be mentioned. These examples are to be considered as illustrative and not restrictive.

(122) 2-(4-methoxyphenyl)-1,3-dioxane
(123) 2-(4-methoxyphenyl)-1,3-dithiane
(124) 2-(3-methoxyphenyl)-1,3-dithiane
(125) 2-(2-methoxyphenyl)-1,3-dioxane
(126) 2-(2-methoxyphenyl)-1,3-dithiane
(127) 2-(4-ethoxyphenyl)-1,3-dithiane
(128) 2-(2-ethoxyphenyl)-1,3-dithiane
(129) 2-(2,4-dimethoxyphenyl)-1,3-dithiane
(130) 2-(2,4-dimethoxyphenyl)-1,3-dithiolane
(131) 2-(2,5-dimethoxyphenyl)-1,3-dithiane
(132) 2-(2,6-dimethoxyphenyl)-1,3-dithiane
(133) 2-(3,4-dimethoxyphenyl)-1,3-dithiane
(134) 2-(3,4-dimethoxyphenyl)-1,3-dithiolane
(135) 2-(3,5-dimethoxyphenyl)-1,3-dithiane
(136) 2-(2,4,6-trimethoxyphenyl)-1,3-dithiane
(137) 2-(3,4,5-trimethoxyphenyl)-1,3-dithiane
(138) 2-(3-methoxy-4-ethoxyphenyl)-1,3-dioxane
(139) 2-(3-methoxy-4-ethoxyphenyl)-1,3-dioxolane
(140) 2-(3-methoxy-4-ethoxyphenyl)-1,3-dithiane
(141) 2-(3-ethoxy-4-methoxyphenyl)-1,3-dithiane
(142) 2-(3,4-diethoxyphenyl)-1,3-dithiane
(143) 2-(3-benzyloxyphenyl)-1,3-dithiane
(144) 2-(2-benzyloxyphenyl)-1,3-dithiane
(145) 2-[3-(4-methylbenzyloxy)phenyl]-1,3-dioxane
(146) 2-[3-(4-methylbenzyloxy)phenyl]-1,3-dithiane
(147) 2-[3-(4-methylbenzyloxy)phenyl]-1,3-dithiolane
(148) 2-[3-(4-methoxybenzyloxy)phenyl]-1,3-dithiane
(149) 2-[3-(4-chlorobenzyloxy)phenyl]-1,3-dithiane
(150) 2-[3-(3,4-dimethylbenzyloxy)phenyl]-1,3-dithiane
(151) 2-[2-(4-methylbenzyloxy)phenyl]-1,3-dithiane
(152) 2-[2-(4-chlorobenzyloxy)phenyl]-1,3-dithiane
(153) 2-[2-(4-methoxybenzyloxy)phenyl]-1,3-dithiane
(154) 2-(3-methoxy-4-benzyloxyphenyl)-1,3-dioxane
(155) 2-(3-methoxy-4-benzyloxyphenyl)-1,3-dioxolane
(156) 2-(3-methoxy-4-benzyloxyphenyl)-1,3-dithiane
(157) 2-(3-methoxy-4-benzyloxyphenyl)-1,3-dithiolane
(158) 2-(3-ethoxy-4-benzyloxyphenyl)-1,3-dithiane
(159) 2-(3-ethoxy-4-benzyloxyphenyl)-1,3-dithiolane
(160) 2-(3-methoxy-4-phenethyloxyphenyl)-1,3-dithiane
(161) 2-(3-ethoxy-4-phenethyloxyphenyl)-1,3-dithiane
(162) 2-(3-benzyloxy-4-methoxyphenyl)-1,3-dioxane
(163) 2-(3-benzyloxy-4-methoxyphenyl)-1,3-dioxolane
(164) 2-(3-benzyloxy-4-methoxyphenyl)-1,3-dithiane
(165) 2-(3-benzyloxy-4-methoxyphenyl)-1,3-dithiolane
(166) 2-(3-benzyloxy-4-methoxyphenyl)-1,3-oxathiolane
(167) 4-methyl-2-(3-benzyloxy-4-methoxyphenyl)-1,3-dithiolane
(168) 4,5-dimethyl-2-(3-benzyloxy-4-methoxyphenyl)-1,3-dithiolane
(169) 2-(2,4-dibenzyloxyphenyl)-1,3-dioxane
(170) 2-(2,4-dibenzyloxyphenyl)-1,3-dithiane
(171) 2-(2,4-dibenzyloxyphenyl)-1,3-dithiolane
(172) 2-(3,4-dibenzyloxyphenyl)-1,3-dioxane
(173) 2-(3,4-dibenzyloxyphenyl)-1,3-dithiane
(174) 2-(3,4-dibenzyloxyphenyl)-1,3-dithiolane
(175) 2-(4-methylthiophenyl)-1,3-dithiane The aromatic compound used in the fourth aspect of this invention can be easily prepared by a conventional method or the like. For example, a benzaldehyde derivative is reacted with a diol such as propanediol or a dithiol such as ethanedithiol, generally with use of an acid catalyst, to obtain a cyclic acetal, cyclic dithioacetal or the like under mild conditions in high yield. Generally, when diol is used, the reaction is carried out while water is removed.

In the fifth aspect of this invention, the aromatic compound is prescribed by that $R^1$ and $R^2$ are hydrogen atoms and $R^3$ is aryloxy group which may have a substituent. That is, the aromatic compound is represented by the structural formula [VI]:

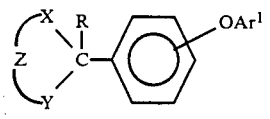

[VI]

wherein X and Y are independently oxygen or sulfur atoms and may or may not be identical with each other, Z is alkylene group which has two or more carbon atoms and may have alkyl group as a side chain, R is hydrogen atom or lower alkyl group, and $Ar^1$ is aryl group which may have a substituent.

As the aromatic compound used in the fifth aspect of this invention, the following compounds may be mentioned. These examples are to be considered as illustrative and not restrictive.

(176) 2-(4-phenoxyphenyl)-1,3-dioxane
(177) 2-(4-phenoxyphenyl)-1,3-dithiane
(178) 2-(4-phenoxyphenyl)-1,3-dithiolane
(179) 2-methyl-2-(4-phenoxyphenyl)-1,3-dithiane
(180) 2-methyl-2-(4-phenoxyphenyl)-1,3-dithiolane
(181) 2-[3-(4-methylphenoxy)phenyl]-1,3-dithiane
(182) 2-[3-(4-methoxyphenoxy)phenyl]-1,3-dithiane
(183) 2-(4-phenoxyphenyl)-1,3-oxathiolane The aromatic compound used in the fifth aspect of this invention can be easily prepared by a conventional method or the like. For example, 4-phenoxybenzaldehyde is reacted with a diol such as propanediol or a dithiol such as ethanedithiol or propanedithiol, generally with use of an acid catalyst, to obtain a cyclic acetal, cyclic dithioacetal or the like under mild conditions in high yield. Generally, when diol is used, the reaction is carried out while water is removed.

In the sixth aspect of this invention, the aromatic compound is prescribed by that $R^1$ and $R^2$ are hydrogen atoms and $R^3$ is $—OZ^1X^1—Ar^1$ group. That is, the aromatic compound is represented by the structural formula [VII]:

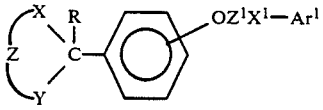

[VII]

wherein X, Y and $X^1$ are independently oxygen or sulfur atoms and may or may not be identical with each other, Z is alkylene group which has two or more carbon atoms and may have alkyl group as a side chain, R is hydrogen atom or lower alkyl group, and $Ar^1$ is aryl group which may have a substituent.

As the aromatic compound used in the sixth aspect of this invention, the following compounds may be mentioned. These examples are to be considered as illustrative and not restrictive.

(184) 2-[4-(2-phenoxyethoxy)phenyl]-1,3-dioxane
(185) 2-methyl-2-[4-(2 phenoxyethoxy)phenyl]-1,3-dioxane
(186) 4-methyl-2-[4-(2-phenoxyethoxy)phenyl]-1,3-dioxane
(187) 5,5-dimethyl-2-[4-(2-phenoxyethoxy)phenyl]-1,3-dioxane
(188) 4,6-dimethyl-2-[4-(2-phenoxyethoxy)phenyl]-1,3-dioxane
(189) 5,5-diethyl-2-[4-(2-phenoxyethoxy)phenyl]-1,3-dioxane
(190) 2-[4-(2-phenoxyethoxy)phenyl]-1,3-dioxolane
(191) 4,5-dimethyl-2-[4-(2-phenoxyethoxy)phenyl]-1,3-dioxolane
(192) 2-[4-(2-phenoxyethoxy)phenyl]-1,3-dioxepane
(193) 2-[4-(2-phenoxyethoxy)phenyl]-1,3-dithiane
(194) 2-methyl-2-[4-(2-phenoxyethoxy)phenyl)-1,3-dithiane
(195) 2-ethyl-2-[4-(2-phenoxyethoxy)phenyl]-1,3-dithiane
(196) 2-[4-(2-phenoxyethoxy)phenyl]-1,3-dithiolane
(197) 2-methyl-2-[4-(2-phenoxyethoxy)phenyl]-1,3-dithiolane
(198) 4-methyl-2-[4-(2-phenoxyethoxy)phenyl]-1,3-dithiolane
(199) 4,5-dimethyl-2-[4-(2-phenoxyethoxy)phenyl]-1,3-dithiolane
(200) 2-[4-(2-phenoxyethoxy)phenyl]-1,3-oxathiolane
(201) 2-[3-(2-phenoxyethoxy)phenyl]-1,3-dioxane
(202) 2-methyl-2-[3-(2-phenoxyethoxy)phenyl]-1,3-dioxane
(203) 2-[3-(2-phenoxyethoxy)phenyl]-1,3-dithiane
(204) 2-methyl-2-[3-(2-phenoxyethoxy)phenyl]-1,3-dithiane
(205) 2-[3-(2-phenoxyethoxy)phenyl]-1,3-dithiolane
(206) 2-methyl-2-[3-(2-phenoxyethoxy)phenyl]-1,3-dithiolane
(207) 2-[2-(2-phenoxyethoxy)phenyl]-1,3-dioxane
(208) 2-methyl-2-[2-(2-phenoxyethoxy)phenyl]1,3-dioxane
(209) 2-[2-(2-phenoxyethoxy)phenyl]-1,3-dithiane
(210) 2-methyl-2-[2-(2-phenoxyethoxy)phenyl]-1,3-dithiolane
(211) 2-[2-(2-phenoxyethoxy)phenyl]-1,3-dithiolane
(212) 2-methyl-2-[2-(2-phenoxyethoxy)phenyl]-1,3-dithiolane
(213) 2-{4-[2-(4-methylphenoxy)ethoxy]phenyl}-1,3-dioxane
(214) 2-methyl-2-{4-[2-(4-methylphenoxy)ethoxy]-phenyl}-1,3-dioxane
(215) 4-methyl-2-{4-[2-(4-methylphenoxy)ethoxy]-phenyl}-1,3-dioxane
(216) 5,5-dimethyl-2-{4-[2-(4-methylphenoxy)ethoxy]-phenyl}-1,3-dioxane
(217) 4,6-dimethyl-2-{4-[2-(4-methylphenoxy)ethoxy}-phenyl}-1,3-dioxane
(218) 5,5-diethyl-2-{4-[2-(4-methylphenoxy)ethoxy]-phenyl}-1,3-dioxane
(219) 2-{4-[2-(4-methylphenoxy)ethoxy]phenyl}-1,3-dioxolane
(220) 4-n-propyl-2-{4-[2-(4-methylphenoxy)ethoxy]-phenyl}-1,3-dioxolane
(221) 4,5-dimethyl-2-{4-[2-(4-methylphenoxy)ethoxy]-phenyl}-1,3-dioxolane
(222) 2-{4-[2-(4-methylphenoxy)ethoxy]phenyl}-1,3-dithiane
(223) 2-methyl-2-{4-[2-(4-methylphenoxy)ethoxy]-phenyl}-1,3-dithiane
(224) 2-ethyl-2-{4-[2-(4-methylphenoxy)ethoxy]-phenyl}-1,3-dithiane (225) 2-{4-[2-(4-methylphenoxy)ethoxy]phenyl}-1,3-dithiolane
(226) 2-methyl-2-{4-[2-(4-methylphenoxy)ethoxy]-phenyl}-1,3-dithiolane
(227) 2-ethyl-2-{4-[2-(4-methylphenoxy)ethoxy]-phenyl}-1,3-dithiolane
(228) 2,4,5-trimethyl-2-{4-[2-(4-methylphenoxy)ethoxy]-phenyl}-1,3-diothiolane
(229) 2-{4-[2-(4-methylphenoxy)ethoxy]phenyl}-1,3-oxathiolane
(230) 2-methyl-2-{4-[2-(4-methylphenoxy)ethoxy]-phenyl}-1,3-oxathiolane
(231) 2-{4-[2-(3-methylphenoxy)ethoxy]phenyl}-1,3-dioxane
(232) 2-{4-[2-(3-methylphenoxy)ethoxy]phenyl}-1,3-dioxane
(233) 2-{4-[2-(3-methylphenoxy)ethoxy]phenyl}-1,3-dithiane
(234) 2-{4-[2-(3-methylphenoxy)ethoxy]phenyl}-1,3-dithiolane
(235) 2-{4-[2-(3-methylphenoxy)ethoxy]phenyl}-1,3-oxathiolane
(236) 2-{4-[2-(2-methylphenoxy)ethoxy]phenyl}-1,3-dioxane
(237) 2-{4-[2-(2-methylphenoxy)ethoxy]phenyl}-1,3-dioxane
(238) 2-{4-[2-(2-methylphenoxy)ethoxy]phenyl}-1,3-dithiane
(239) 2-{4-[2-(2-methylphenoxy)ethoxy]phenyl}-1,3-dithiolane
(240) 2-{4-[2-(2-methylphenoxy)ethoxy]phenyl}-1,3-oxathiolane
(241) 2-{4-[2-(2,4-dimethylphenoxy)ethoxy]phenyl}-1,3-dioxane
(242) 2-{4-[2-(3,4-dimethylphenoxy)ethoxy]phenyl}-1,3-dioxane
(243) 2-{4-[2-(2,4-dimethylphenoxy)ethoxy]phenyl}-1,3-dithiane
(244) 2-{4-[2-(3,4-dimethylphenoxy)ethoxy]phenyl}-1,3-dithiane
(245) 2-{4-[2-(2,4-dimethylphenoxy)ethoxy]phenyl}-1,3-dithiolane
(246) 2-{4-[2-(3,4-dimethylphenoxy)ethoxy]phenyl}-1,3-dithiolane
(247) 2-{4-[2-(4-chlorophenoxy)ethoxy]phenyl}-1,3-dioxane
(248) 2-{4-[2-(4-chlorophenoxy)ethoxy]phenyl}-1,3-dioxolane
(249) 2-{4-[2-(4-chlorophenoxy)ethoxy]phenyl}-1,3-dithiane
(250) 2-{4-[2-(4-chlorophenoxy)ethoxy]phenyl}-1,3-dithiolane
(251) 2-{4-[2-(4-chlorophenoxy)ethoxy]phenyl}-1,3-oxathiolane
(252) 2-{4-[2-(3-chlorophenoxy)ethoxy]phenyl}-1,3-dioxane
(253) 2-{4-[2-(3-chlorophenoxy)ethoxy]phenyl}-1,3-dioxolane
(254) 2-{4-[2-(3-chlorophenoxy)ethoxy]phenyl}-1,3-dithiane
(255) 2-{4-[2-(3-chlorophenoxy)ethoxy]phenyl}-1,3-dithiolane
(256) 2-{4-[2-(3-chlorophenoxy)ethoxy]phenyl}-1,3-oxathiolane
(257) 2-{4-[2-(2,4-dichlorophenoxy)ethoxy]phenyl}-1,3-dithiolane
(258) 2-{4-[2-(2,3-dichlorophenoxy)ethoxy]phenyl}-1,3-dithiolane
(259) 2-{4-[2-(2,6-dichlorophenoxy)ethoxy]phenyl}-1,3-dithiolane
(260) 2-}4-[2-(4-methoxyphenoxy)ethoxy]phenyl}-1,3-dioxane
(261) 2-{4-[2-(4-methoxyphenoxy)ethoxy]phenyl}-1,3-dioxolane
(262) 2-{4-[2-(4-methoxyphenoxy)ethoxy]phenyl}-1,3-dithiane
(263) 2-{4-[2-(4-methoxyphenoxy)ethoxy]phenyl}-1,3-dithiolane
(264) 2-{4-[2-(4-methoxyphenoxy)ethoxy]phenyl}-1,3-oxathiolane
(265) 2-{4-[2-(4-methylthiophenoxy)ethoxy]phenyl}-1,3-dithiolane
(266) 2-[4-(1-phenoxyethoxy)phenyl]-1,3-dioxane
(267) 2-[4-(1-methyl-2-phenoxyethoxy)phenyl]-1,3-dithiolane
(268) 2-[4-(3-phenoxypropoxy)phenyl]-1,3-dithiolane
(269) 2-[4-(4-phenoxybutoxy)phenyl]-1,3-dithiolane
(270) 2-[4-(2-phenylthioethoxy)phenyl]-1,3-dioxane
(271) 2-[4-(2-phenylthioethoxy)phenyl]-1,3-dithiolane
(272) 2-{4-[2-(4-methylphenylthio)ethoxy]phenyl}-1,3-dithiolane
(273) 2-{4-[2-(3-methylphenylthio)ethoxy]phenyl}-1,3-dithiolane
(274) 2-{4-[2-(4-chlorophenylthio)ethoxy]phenyl}-1,3-dithiolane
(275) 2-{4-[2-(3-methylphenylthio)ethoxy]phenyl)-1,3-dithiolane The aromatic compound used in the sixth aspect of this invention can be easily prepared by a conventional method or the like. For example, a derivative of benzaldehyde, acetophenone or the like is reacted with a diol, dithiol or 2-mercaptoethanol, generally with use of an acid catalyst, to obtain a cyclic acetal, a cyclic ketal, a cyclic dithioacetal, a cyclic dithioketal, or the like under mild conditions in high yield. Generally, when a diol or 2-mercaptoethanol is used, the reaction is carried out while water is removed.

In the seventh aspect of this invention, the aromatic compound is prescribed by that R is alkyl group, and $R^1$, $R^2$ and $R^3$ are hydrogen atoms, alkoxy groups, or aralkyloxy or aralkenyloxy groups which may have a substituent. That is, the aromatic compound is represented by the structural formula [VIII]:

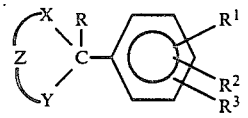

[VIII]

wherein X and Y are independently oxygen or sulfur atoms and may or may not be identical with each other, Z is alkylene group which has two or more carbon atoms and may have alkyl group as a side chain, R is alkyl group, $R^1$, $R^2$ and $R^3$ are hydrogen atoms, alkoxy groups, or aralkyloxy or aralkenyloxy groups which may have a substituent, two of $R^1$, $R^2$ and $R^3$ may be linked with each other to form a cyclic structure, and all of $R^1$, $R^2$ and $R^3$ are not hydrogen atoms at the same time.

As the aromatic compound used in the seventh aspect of this invention, the following compounds may be mentioned. These examples are to be considered as illustrative and not restrictive.

(276) 2-methyl-2-(4-benzyloxyphenyl)-1,3-dioxane
(277) 2-methyl-2-(4-benzyloxyphenyl)-1,3-dithiane (278) 2-methyl-2-(4-benzyloxyphenyl)-1,3-dithiolane
(279) 2-ethyl-2-(4-benzyloxyphenyl)-1,3-dithiane
(280) 2-ethyl-2-(4-benzyloxyphenyl)-1,3-dithiolane
(281) 2-methyl-2-[4-(4-methylbenzyloxy)phenyl]-1,3-dioxane
(282) 2-methyl-2-[4-(4-methylbenzyloxy)phenyl]-1,3-dioxolane
(283) 2-methyl-2-[4-(4-methylbenzyloxy)phenyl]-1,3-dithiane
(284) 2-methyl-2-[4-(4-methylbenzyloxy)phenyl]-1,3-dithiolane
(285) 2,4,5-trimethyl-2-[4-(4-methylbenzyloxy)phenyl]-1,3-dithiolane
(286) 2-ethyl-2-[4-(4-methylbenzyloxy)phenyl]-1,3-dithiane
(287) 2-ethyl-2-[4-(4-methylbenzyloxy)phenyl]-1,3-dithiolane
(288) 2-ethyl-2-[4-(4-methylbenzyloxy)phenyl]-1,3-oxathiolane
(289) 2-methyl-2-[4-(3-methylbenzyloxy)phenyl]-1,3-dithiane
(290) 2-methyl-2-[4-(2-methylbenzyloxy)phenyl]-1,3-dithiane
(291) 2-methyl-2-[4-(4-chlorobenzyloxy)phenyl]-1,3-dioxane
(292) 2-methyl-2-[4-(4-chlorobenzyloxy)phenyl]-1,3-dioxolane
(293) 2-methyl-2-[4-(4-chlorobenzyloxy)phenyl]-1,3-dithiane
(294) 2-methyl-2-[4-(4-chlorobenzyloxy)phenyl]-1,3-dithiolane
(295) 2-methyl-2-[4-(4-methoxybenzyloxy)phenyl]-1,3-dioxane
(296) 2-methyl-2-[4-(4-methoxybenzyloxy)phenyl]-1,3-dithiane
(297) 2-methyl-2-[4-(4-methoxybenzyloxy)phenyl]-1,3-dithiolane
(298) 2-methyl-2-[3-(4-methylbenzyloxy)phenyl]-1,3-dithiane
(299) 2-methyl-2-[3-(4-methylbenzyloxy)phenyl]-1,3-dithiolane
(300) 2-methyl-2-[2-(4-methylbenzyloxy)phenyl]-1,3-dithiane
(301) 2-methyl-2-[2-(4-methylbenzyloxy)phenyl]-1,3-dithiolane
(302) 2-methyl-2-(3-methoxy-4-benzyloxyphenyl)-1,3-dithiane
(303) 2-methyl-2-(4-methoxyphenyl)-1,3-dithiane
(304) 2-methyl-2-(2,4-dimethoxyphenyl)-1,3-dithiane
(305) 2-methyl-2-(3,4-dimethoxyphenyl)-1,3-dithiane
(306) 2-methyl-2-(3,4,5-trimethoxyphenyl)-1,3-dithiane
(307) 2-methyl-2-(2,4-dibenzyloxyphenyl)-1,3-dithiane
(308) 2-methyl-2-(4-phenethyloxyphenyl)-1,3-dithiane
(309) 2-methyl-2-[4-(3-phenylpropoxy)phenyl]-1,3-dithiane
(310) 2-methyl-2-[4-(3-phenylpropoxy)phenyl]-1,3-dithiolane
(311) 2-methyl-2-(4-cinnamyloxyphenyl)-1,3-dioxane
(312) 2-methyl-2-(4-cinnamyloxyphenyl)-1,3-dioxolane
(313) 2-methyl-2-(4-cinnamyloxyphenyl)-1,3-dithiane
(314) 2-methyl-2-(4-cinnamyloxyphenyl)-1,3-dithiolane
(315) 2-ethyl-2-(4-cinnamyloxyphenyl)-1,3-dithiane
(316) 2-ethyl-2-(4-cinnamyloxyphenyl)-1,3-dithiolane
(317) 2-methyl-2-(3,4-methylenedioxyphenyl)-1,3-dithiane The aromatic compound used in the seventh aspect of this invention can be easily prepared by a conventional method or the like. For example, an aromatic ketone such as acetophenone derivative is reacted with a diol such as propanediol or a dithiol such as ethanedithiol, generally with use of an acid catalyst, to obtain a cyclic acetal, a cyclic dithioacetal or the like under mild conditions in high yield. Generally, when a diol is used, the reaction is carried out while water is removed.

Synthesis Examples of some compounds used in the seventh aspect of this invention are specifically described below. These Examples are to be considered as illustrative and not restrictive.

SYNTHESIS EXAMPLE 4 Synthesis of 2-methyl-2-(4-benzyloxyphenyl)-1,3-dithiane (compound 277)

27.2 g of 4-hydroxyacetophenone is mixed with 100 ml of dimethylformamide, 25.3 g of benzyl chloride and 30.4 g of potassium carbonate. The resulting mixture is stirred in a stream of nitrogen at 100°–110° C. for 3 hours and then cooled. The cooled mixture is added to about 2 l of ice water to deposit solid. The solid is separated therefrom by filtration and then washed with water until the solid becomes neutral. The washed solid is dried and then recrystallized from 500 ml of ethanol to obtain 38.8 g of 4-benzyloxyacetophenone. Thus obtained 4-benzyloxyacetophenone has a melting point of 92.5°–93° C.

11.3 g of 4-benzyloxyacetophenone obtained above is mixed with 100 ml of ethanol, 5.0 ml of 1,3-propanedithiol and 1.5 g of boron trifluoride ethyl etherate. The resulting mixture is refluxed for 5 hours and then cooled to deposit crystals. The crystals are separated therefrom by filtration and then washed with ethanol. The washed crystals are recrystallized from 400 ml of ethanol to obtain 12.6 g of the objective compound. Thus obtained compound has a melting point of 121°–121.5° C.

SYNTHESIS EXAMPLE 5 Synthesis of 2-methyl-2-(4-benzyloxyphenyl)-1,3-dithiolane (compound 278)

11.3 g of 4-benzyloxyacetophenone obtained in Synthesis Example 4 is mixed with 100 ml of ethanol, 4.2 ml of 1,2-ethanedithiol and 1.5 g of boron trifluoride ethyl etherate. The resulting mixture is refluxed for 5 hours and then cooled to deposit crystals. The crystals are separated therefrom by filtration and then washed with ethanol. The washed crystals are recrystallized from 200 ml of ethanol to obtain 10.4 g of the objective compound. Thus obtained compound has a melting point of 70.5°–71° C.

SYNTHESIS EXAMPLE 6 Synthesis of 2-ethyl-2-(4-benzyloxy-phenyl)-1,3-dithiane (compound 279)

19.8 g of 4-benzyloxypropiophenone is obtained by the reaction of 15.0 g of 4-hydroxypropiophenone with 17.1 g of benzylchloride in the same manner as in Synthesis Example 4. 4-benzyloxypropiophenone thus obtained has a melting point of 101.5°–102° C.

And then 10.1 g of the objective compound is obtained by the reaction of 9.6 g of 4-benzyloxypropiophenone obtained above with 4.0 ml of propanedithiol in the same manner as in Synthesis Example 4. Thus obtained compound has a melting point of 101.5°–102° C.

SYNTHESIS EXAMPLE 7 Synthesis of 2-ethyl-2-(4-benzyloxy-phenyl)-1,3-dithiolane (compound 280)

8.2 g of the objective compound is obtained by the reaction of 9.6 g of 4-benzyloxypropiophenone obtained in Synthesis Example 6 with 3.4 ml of 1,2-ethanedithiol in the same manner as in Synthesis Example 5. Thus obtained compound has a melting point of 52°-53° C.

SYNTHESIS EXAMPLE 8 Synthesis of 2-methyl-2-[4-(4-methylbenzyloxy)

phenyl]-1,3-dithiolane (compound 284)

43.3 g of 4-(4-methylbenzyloxy)acetophenone is obtained by the reaction of 27.2 g of 4-hydroxyacetophenone and 28.1 g of 4-methylbenzylchloride in the same manner as in Synthesis Example 4. 4-(4-methylbenzyloxy)acetophenone thus obtained has a melting point of 104°-104.5° C.

And then 27.4 g of the objective compound is obtained by the reaction of 30.0 g of 4-(4-methylbenzyloxy)acetophenone obtained above with 10.5 ml of 1,2-ethanedithiol in the same manner as in Synthesis Example 5. Thus obtained compound has a melting point of 91.5°-92.5° C.

SYNTHESIS EXAMPLE 9 Synthesis of 2-methyl-2-[4-(4-chlorobenzyloxy)

phenyl]-1,3-dithiolane (compound 294)

28.2 g of 4-(4-chlorobenzyloxy)acetophenone is obtained by the reaction of 16.3 g of 4-hydroxyacetophenone with 19.3 g of 4-chlorobenzylchloride in the same manner as in Synthesis Example 4. 4-(4-chlorobenzyloxy)-acetophenone thus obtained has a melting point of 141.5°-142.5° C.

And then 11.7 g of the objective compound is obtained by the reaction of 13.0 g of 4-(4-chlorobenzyloxy)acetophenone obtained above with 4.2 ml of 1,2-ethanedithiol in the same manner as in Synthesis Example 5. Thus obtained compound has a melting point of 94°-95.4° C.

SYNTHESIS EXAMPLE 10 Synthesis of 2-methyl-2-(3,4-methyl-enedioxyphenyl)-1,3-dithiane (compound 317)

5.3 g of the objective compound is obtained by the reaction of 6.6 g of 3,4-methylenedioxyacetophenone and 4.0 ml of propanedithiol in the same manner as in Synthesis Example 4. Thus obtained compound has a melting point of 77°-78° C.

In the eighth aspect of this invention, the aromatic compound is prescribed by that R, $R^1$ and $R^2$ are hydrogen atoms and $R^3$ is —$OZ^1X^1$—$Ar^1$ group, wherein $X^1$ is a single bond. That is, the aromatic compound is represented by the structural formula [IX]:

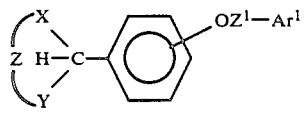

[IX]

wherein X and Y are independently oxygen or sulfur atoms and may or may not be identical with each other, Z is an alkylene group which has two or more carbon atoms and may have an alkyl group as a side chain, $Z^1$ is an alkylene or alkenylene group which has two or more carbon atoms and may have an alkyl group as a side chain, and $Ar^1$ is a substituted or unsubstituted aryl group.

As the aromatic compound used in the eighth aspect of this invention, the following compound may be mentioned. These examples are to be considered as illustrative and not restrictive.

(318) 2-(4-phenethyloxyphenyl)-1,3-dioxane
(219) 2-(4-phenethyloxyphenyl)-1,3-dithiane
(320) 2-(4-phenethyloxyphenyl)-1,3-dithiolane
(321) 2-[4-(4-methylphenethyloxy)phenyl]-1,3-dioxane
(322) 2-[4-(4-methylphenethyloxy)phenyl]-1,3-dithiane
(323) 2-[4-(4-methylphenethyloxy)phenyl]-1,3-dithiolane
(324) 2-[4-(1-phenylethoxy)phenyl]-1,3-dioxane
(325) 2-[4-(1-phenylethoxy)phenyl]-1,3-dithiane
(326) 2-[4-(1-phenylethoxy)phenyl]-1,3-dithiolane
(327) 2-[4-(3-phenylpropoxy)phenyl]-1,3-dithiane
(328) 2-[4-(2-phenylpropoxy)phenyl]-1,3-dithiane
(329) 2-(2-cinnamyloxyphenyl)-1,3-dioxane
(330) 2-(3-cinnamyloxyphenyl)-1,3-dioxane
(331) 2-(4-cinnamyloxyphenyl)-1,3-dioxane
(332) 4-methyl-2-(4-cinnamyloxyphenyl)-1,3-dioxane
(333) 4,6-dimethyl-2-(4-cinnamyloxyphenyl)-1,3-dioxane
(334) 5,5-dimethyl-2-(4-cinnamyloxyphenyl)-1,3-dioxane
(335) 2-(4-cinnamyloxyphenyl)-1,3-dioxolane
(336) 4,5-dimethyl-2-(4-cinnamyloxyphenyl)-1,3-dioxolane
(337) 2-(4-cinnamyloxyphenyl)-1,3-oxathiolane
(338) 2-(2 cinnamyloxyphenyl)-1,3-dithiane
(339) 2-(3-cinnamyloxyphenyl)-1,3-dithiane
(340) 2-(4-cinnamyloxyphenyl)-1,3-dithiane
(341) 2-(4-cinnamyloxyphenyl)-1,3-dithiolane
(342) 4,5-dimethyl-2-(4-cinnamyloxyphenyl)-1,3-dithiolane The aromatic compound used in the eighth aspect of this invention can be easily prepared by a conventional method or the like. For example, 4-hydroxybenzaldehyde is reacted with a diol such as propanediol or a dithiol such as ethanedithiol, generally with use of an acid catalyst, to obtain a cyclic acetal, a cyclic dithioacetal or the like. Generally, when a diol is used, the reaction is carried out while water is removed. And then, the desired compound can be prepared by reacting the cyclic acetal or cyclic dithioacetal thus obtained with e.g. phenethyl chloride or cinnamyl chloride in the presence of an alkali. Alternatively, 4-hydroxybenzaldehyde is reacted with e.g. phenethyl chloride or cynnamyl chloride in the presence of an alkali, and then the reaction product is acetalized or thioacetalized as described above to obtain the objective compound.

Synthesis Examples of some compounds used in the eighth aspect of this invention are specifically described below. These Examples are to be considered as illustrative and not restrictive.

SYNTHESIS EXAMPLE 11 Synthesis of 2-(4-phenethyloxy-phenyl)-1,3-dithiane (compound 319)

12.2 g of 4-hydroxybenzaldehyde is mixed with 35 ml of dimethylformamide, 16.9 g of (2-chloroethyl)benzene and 16.6 g of potassium carbonate. The resulting mixture is stirred in a stream of nitrogen at 80°-90° C. for 10 hours and then cooled. The cooled mixture is added to 500 ml of water and then extracted with 500 ml of chloroform. The extract is washed with water until it becomes neutral. The washed extract is dried with anhydrous sodium sulfate and then chloroform is distilled away. The resulting residue is distilled under reduced pressure to obtain 11.4 g of 4-phenethyloxybenzaldehyde. Thus obtained 4-phenethyloxybenzaldehyde has a boiling point of 173°-181° C./2-3 mmHg.

4.5 g of 4-phenethyloxybenzaldehyde obtained above is mixed with 50 ml of ethanol, 2.0 ml of 1,3-propanedithiol and 0.3 g of boron trifluoride ethyl etherate. The resulting mixture is stirred at room temperature for 1 hour to deposit crystals. The crystals are separated therefrom by filtration and then washed with ethanol. The washed crystals are recrystallized from 150 ml of ethanol to obtain 5.1 g of the objective compound. Thus obtained compound has a melting point of 100°-100.5° C.

SYNTHESIS EXAMPLE 12 Synthesis of 2-(4-phenyethyloxy-phenyl)-1,3-dithiolane (compound 320)

4.5 g of 4-phenethyloxybenzaldehyde obtained in Synthesis Example 11 is mixed with 50 ml of ethanol, 1.7 ml of 1,2-ethanedithiol and 0.3 g of boron trifluoride ethyl etherate. The resulting mixture is stirred at room temperature for 1 hour to deposit crystals. The crystals are separated therefrom by filtration and then washed with ethanol. The washed crystals are recrystallized from 100 ml of methanol to obtain 3.8 g of the objective compound. Thus obtained compound has a melting point of 73.5°-74° C.

SYNTHESIS EXAMPLE 13 Synthesis of 2-(4-cinnamyloxy-phenyl)-1,3dioxane (compound 331)

24.4 g of 4-hydroxybenzaldehyde is mixed with 50 ml of dimethylformamide, 30.4 g of cinnamyl chloride and 30.4 g of potassium carbonate. The resulting mixture is stirred in a stream of nitrogen at 100°-110° C. for 5 hours and then cooled. The cooled mixture is added to 2 l of ice water to deposit solid. The solid is separated therefrom by filtration and then washed with water until the solid becomes neutral. The washed solid is dried and then recrystallized from 200 ml of ethanol to obtain 36.4 g of 4-cinnamyloxybenzaldehyde. Thus obtained 4-cinnamyloxybenzaldehyde has a melting point of 89.5°-90.5° C.

11.8 g of 4-cinnamyloxybenzaldehyde obtained above is mixed with 100 ml of benzene, 10 ml of dimethylformamide, 7.6 g of 1,3-propanediol and 0.5 g of p-toluenesulfonic acid monohydrate. The resulting mixture is refluxed with stirring for 5 hours while produced water is removed as an azetrope with benzene. The reaction mixture is washed with 5% aqueous solution of sodium carbonate and then with water. The washed mixture is dried with anhydrous sodium sulfate and then the solvent is distilled away. The resulting residue is recrystallized from 300 ml of isopropanol to obtain 13.9 g of the objective compound. Thus obtained compound has a melting point of 125-125.5° C.

SYNTHESIS EXAMPLE 14 Synthesis of 2-(4-cinnamyloxy-phenyl)-1,3-dioxolane (compound 335)

11.8 g of 4-cinnamyloxybenzaldehyde obtained in Synthesis Example 13 is mixed with 100 ml of benzene, 10 ml of dimethylformamide, 6.2 g of ethylene glycol and 0.5 g of p-toluenesulfonic acid monohydrate. The resulting mixture is refluxed with stirring for 5 hours while produced water is removed as an azetrope with benzene. The reaction product is washed with 5% aqueous solution of sodium carbonate and then with water. The washed mixture is dried with anhydrous sodium sulfate and then the solvent is distilled away. The resulting residue is recrystallized from 300 ml of isopropanol to obtain 12.0 g of the objective compound. Thus obtained compound has a melting point of 102°-102.5° C.

SYNTHESIS EXAMPLE 15: Synthesis of 2-(4-cinnamyloxyphenyl)-1,3-dithiolane (compound 341)

11.8 g of 4-cinnamyloxybenzaldehyde obtained in Synthesis Example 13 is mixed with 20 ml of ethanol, 4.2 ml of 1,2-ethanedithiol and 1.5 g of boron trifluoride ethyl etherate. The resulting mixture is stirred at room temperature for 1 hour to deposit crystals. The crystals are separated therefrom by filtration and then washed with ethanol. The washed crystals are recrystallized from 300 ml of ethanol to obtain 12.6 g of the objective compound. Thus obtained compound has a melting point of 96°-97° C.

The process for producing the heat-sensitive recording material of this invention (including first to eighth aspects) is specifically explained below.

The heat sensitive recording material of this invention comprises a support having provided thereon a heat-sensitive recording layer comprising, as essential components, an electron-donating dye precursor which is generally colorless or pale-colored and an electron-accepting developer. Upon heating the heat-sensitive recording material by a thermal head, a thermal pen, a laser beam, or the like, the dye precursor and the developer instantly react with each other to give recorded images. Such heat-sensitive recording materials are disclosed in Japanese Pat. Appln. Kokoku Nos. S.43-4160 and S.45-14039 and the like. If necessary, the heat-sensitive recording layer may contain a pigment, sensitizer, antioxidant, antisticking agent, and the like.

In this invention, any dye precursor which is generally used for pressure-sensitive recording papers or heat-sensitive recording papers. Specifically, the following compounds may be mentioned:

(i) Triarylmethane Type Compounds 3,3-bis(p-dimethylaminophenyl)-6-dimethylaminophthalide (Crystal Violet Lactone), 3,3-bis-(p-dimethylaminophenyl)phthalide, 3-(p-dimethyl-aminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide, etc.

(ii) Diphenylmethane Type Compounds 4,4'-bis(dimethylaminophenyl)benzhydryl benzyl ether, N-chlorophenylleucoauramine, N-2,4,5-trichloro-phenylleucoauramine, etc.

(iii) Xanthene Type Compounds

Rhodamine B anilinolactam, Rhodamine B p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilino)fluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tetrahydrofuryl)-amino-6-methyl-7-anilinofluoran, etc.

(iv) Thiazine Type Compound

Benzoyl Leucomethylene Blue, p-nitrobenzoyl Leucomethylene Blue, etc.

(v) Spiro Type Compound 3-methylspirodinaphthopyran, 3-ethyl-spirodinaphthopyran, 3,3'-dichlorospirodinaphthopyran, 3-benzylspirodinaphthopyran, 3-methylnaphtho-(3methoxybenzo)spiropyran, 3-propylspirobenzopyran, etc.

These compounds may be used alone or in combination of two or more.

In this invention, any developer which is an acidic, electron-accepting compound and generally used for heat-sensitive recording papers can be used. For example, phenol derivatives, aromatic carboxylic acid derivatives, N,N'-diarylthiourea derivatives, polyvalent metal salts (e.g. zinc salt) of organic compounds, and the like can be used. Among these compounds, phenol derivatives are especially preferable. Specifically, there may be mentioned p-phenylphenol, p-hydroxyacetophenone, 4-hydroxy-4'-methyldiphenylsulfone, 4-hydroxy-4'-isopropoxydiphenylsulfone, 4-hydroxy-4'-benzenesulfonyloxydiphenylsulfone, 1,1-bis(p-hydroxyphenyl)propane, 1,1-bis(p-hydroxyphenyl)-pentane, 1,1-bis(p-hydroxyphenyl)hexane, 1,1-bis(p-hydroxyphenyl)cyclohexane, 2,2-bis(p-hydroxyphenyl)propane, 2,2-bis(p-hydroxyphenyl)-hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-bis[2-(p-hydroxyphenyl)-2-propyl]-benzene, 1,3-bis[2-(3,4-dihydroxy-phenyl)-2-propyl]-benzene, 1,4-bis[2-(p-hydroxyphenyl)-2-propyl]benzene, 4,4'-dihydroxydiphenyl ether, 4,4'-dihydroxydiphenylsulfone, 3,3'-dichloro-4,4'-dihydroxydiphenylsulfone, 3,3'-diallyl-4,4'-dihydroxydiphenylsulfone, 3,3'-dichloro-4,4'-dihydroxydiphenylsulfide, methyl 2,2-bis(4-hydroxyphenyl)acetate, butyl 2,2-bis(4-hydroxyphenyl)acetate, 4,4'-thiobis(2-tert-butyl-5-methylphenol), benzyl p-hydroxybenzoate, chlorobenzyl p-hydroxybenzoate, dimethyl 4-hydroxyphthalate, benzyl gallate, stearyl gallate, salicylanilide, 5-chlorosalicylanilide, and the like.

The binder used in this invention includes water-soluble binders such as starches, hydroxyethyl-cellulose, methylcellulose, carboxymethylcellulose, gelatin, casein, polyvinylalcohol, modified polyvinyl alcohol, sodium polyacrylate, acrylamide/acrylic acid ester copolymer, acrylamide/acrylic acid ester/methacrylic acid terpolymer, alkali salts of styrene/maleic anhydride copolymer, alkali salts of ethylene/maleic anhydride copolymer, etc; latexes such as polyvinyl acetate, polyurethane, polyacrylic acid ester, styrene/butadiene copolymer, acrylonitrile/butadiene copolymer, methyl acrylate/butadiene copolymer, ethylene/vinyl acetate copolymer, etc; and the like.

In addition to the above components, the heat-sensitive layer may contain the following compounds in order to further improve sensitivity: a wax such as N-hydroxymethylstearamide, stearamide or palmitamide; a naphthol derivative such as 2-benzyloxynaphthalene; a biphenyl derivative such as p-benzylbiphenyl or 4-allyloxybiphenyl; a polyether compound such as 1,2-bis(3-methylphenoxy)ethane, 2,2'-bis(4-methoxyphenoxy)diethyl ether or bis(4-methoxyphenyl) ether; a derivative of carbonic acid ester or oxalic acid ester such as diphenyl carbonate, dibenzyl oxalate or bis(p-methylbenzyl) oxalate; and the like.

As the pigments, there may be mentioned diatomaceous earth, talc, kaolin, calcined kaolin, calcium carbonate, magnesium carbonate, titanium oxide, zinc oxide, silicon oxide, aluminum hydroxide, urea-formaldehyde resin, and the like.

For the purpose of the prevention of head abrasion, sticking, and the like, if necessary, the heat-sensitive recording layer may further contain a metal salt of a higher fatty acid such as zinc stearate or calcium stearate; a wax such as paraffin, oxidized paraffin, polyethylene, oxidized polyethylene, stearamide or castor wax; a dispersant such as sodium dioctylsulfosuccinate; an ultraviolet-ray absorbent of benzophenone type, benzotriazole type or the like; a surfactant; a fluorescent dye; and the like.

As the support used in this invention, mainly used is a paper; however, a nonwoven fabric, a plastic film, a synthetic paper, a metal foil, a composite sheet consisting of a combination of them, or the like can also be used.

Moreover, various arts well-known in the field of heat-sensitive recording materials can be utilized. For example, an overcoating layer can be provided on the heat-sensitive recording layer in order to protect the heat-sensitive recording layer, and an undercoating layer can be provided between the heat-sensitive recording layer and the support, which undercoating layer comprises a pigment and/or a resin and has a single-layered or multilayered structure.

The coating weight of the heat-sensitive recording layer is determined by the amount of the color-forming components, i.e. the dye precursor and developer. In general, the amount of the dye precursor is preferably 0.1–1.0 g/m$^2$. The amount of the developer is preferably 5–400% by weight, more preferably 20–300% by weight, based on the weight of the dye precursor.

The aromatic compound is contained in an amount of preferably 5–400% by weight, more preferably 20–300% by weight, based on the weight of the developer.

The following Examples further illustrate the invention.

Hereinafter, "part(s)" and "%" represent "part(s) by weight" and "% by weight" respectively.

(I) Preparation of a Heat-Sensitive Recording Material

Example 1

(1) Preparation of a Coating Composition for a heat-sensitive recording layer

To 80 parts of a 2.5% aqueous solution of polyvinyl alcohol was added 35 parts of 3-dibutylamino-6-methyl-7-anilinofluoran as a dye precursor. The resulting mixture was ground in a ball mill for 24 hours to obtain a dye dispersion.

On the other hand, to 60 parts of a 2.5% aqueous solution of polyvinyl alcohol was added 40 parts of 2,2-bis(p-hydroxyphenyl)propane as a developer. The resulting mixture was ground in a ball mill for 24 hours to obtain a developer dispersion.

To 120 parts of a 2.5% aqueous solution of polyvinyl alcohol was added 50 parts of 2-(4-benzyloxy-phenyl)-1,3-dioxane (compound 1). The resulting mixture was ground in a ball mill for 24 hours to obtain an aromatic compound dispersion.

The three dispersions obtained above were mixed with one another. To the resulting dispersion mixture was added the following composition with stirring and mixed enough to obtain a coating composition for a heat-sensitive recording layer.

| | |
|---|---|
| 50% dispersion of calcium carbonate: | 100 parts |
| 40% dispersion of zinc stearate: | 25 parts |
| 10% aqueous solution of polyvinyl alcohol: | 185 parts |
| Water: | 280 parts |

(2) Preparation of a Paper for a Heat-Sensitive Recording Material

A coating composition containing the following components was coated on a base paper having a basic weight of 40 g/m$^2$ so as to obtain a coating weight of 9 g/m$^2$ in terms of solid content. Thus coated paper was dried to obtain a paper for a heat-sensitive recording paper.

| | |
|---|---|
| Calcined kaolin: | 100 parts |
| 50% dispersion of styrene-butadiene type latex: | 24 parts |
| Water: | 200 parts |

(3) Preparation of a Heat-Sensitive Recording Material

The coating composition for a heat-sensitive recording layer obtain in (1) above was coated on the paper for a heat-sensitive recording material obtained in (2) above so as to obtain a coating weight of 4 g/m$^2$ in terms of solid content. Thus coated paper was dried to obtain a heat-sensitive recording material.

EXAMPLES 2-8

The same procedure as in Example 1 was repeated, except that the following compounds were used instead of 2-(4-benzyloxyphenyl)-1,3-dioxane (compound 1) used in Example 1 to obtain a heat-sensitive recording material.

Example 2: 2-(4-benzyloxyphenyl)-1,3-dithiolane (compound 3)

Example 3: 2-[4-(4-methylbenzyloxy)phenyl]-1,3-dioxolane (compound 6)

Example 4: 2-[4-(4-methylbenzyloxy)phenyl]-1,3-oxathiolane (compound 9)

Example 5: 2-[4-(3-methylbenzyloxy)phenyl]-1,3-dithiolane (compound 15)

Example 6: 2-[4-(4-methoxybenzyloxy)phenyl]]-1,3-dithiolane (compound 21)

Example 7: 2-[4-(4-chlorobenzyloxy)phenyl]-1,3-dithiolane (compound 27)

Example 8: 2-[4-(3-chlorobenzyloxy)phenyl]-1,3-dithiolane (compound 32)

Comparative Example 1

The same procedure as in Example 1 was repeated, except that 2-(4-benzyloxyphenyl)-1,3-dioxane (compound 1) used in Example 1 was eliminated to obtain a heat-sensitive recording material.

Comparative Example 2

The same procedure as in Example 1 was repeated, except that N-hydroxymethylstearamide was used instead of 2-(4-benzyloxyphenyl)-1,3-dioxane (compound 1) used in Example 1 to obtain a heat-sensitive recording material.

(II) Evaluation of a Heat-Sensitive Recording Material

The heat-sensitive recording materials obtained in (I) above were subjected to calendering treatment so that the side where the heat-sensitive recording layer was provided had a Bekk smoothness of 400-500 sec. And then on the heat-sensitive recording materials, printing was carried out by a facsimile tester (manufactured by Okura Denki K. K., TH-PMD) at a heat voltage of 12 V and a pulse width of 0.5, 0.6 or 0.7 ms using a thermal head having a dot density of 8 dots/mm and a head resistance of 185 Ω.

Optical densities of thus printed portion and unprinted portion (i.e. while ground) were measured by a Macbeth RD-918 type reflection densitometer. The results are shown in Table 1.

TABLE 1

| | Optical density | | | |
|---|---|---|---|---|
| | Unprinted portion | Printed portion | | |
| | | 0.5 ms | 0.6 ms | 0.7 ms |
| Example 1 | 0.05 | — | 1.12 | 1.25 |
| Example 2 | 0.05 | — | 1.24 | 1.38 |
| Example 3 | 0.05 | — | 1.30 | 1.41 |
| Example 4 | 0.05 | — | 1.26 | 1.37 |
| Example 5 | 0.05 | — | 1.13 | 1.31 |
| Example 6 | 0.05 | — | 1.15 | 1.35 |
| Example 7 | 0.05 | — | 1.08 | 1.32 |
| Example 8 | 0.05 | — | 1.12 | 1.32 |
| Comparative Example 1 | 0.05 | — | 0.61 | 0.84 |
| Comparative Example 2 | 0.06 | — | 0.96 | 1.21 |

Examples 9 and 10

The same procedure as in Example 1 was repeated, except that compounds 92 and 93 were respectively used in Examples 9 and 10 instead of compound 1 to obtain heat-sensitive recording materials and evaluate them. The results are shown in Table 2.

TABLE 2

| | Optical density | | | |
|---|---|---|---|---|
| | Unprinted portion | Printed portion | | |
| | | 0.5 ms | 0.6 ms | 0.7 ms |
| Example 9 | 0.05 | 0.87 | — | 1.25 |

TABLE 2-continued

| | Optical density | | | |
|---|---|---|---|---|
| | Unprinted portion | Printed portion 0.5 ms | 0.6 ms | 0.7 ms |
| Example 10 | 0.04 | 0.93 | — | 1.34 |
| Comparative Example 1 | 0.05 | 0.47 | — | 0.85 |
| Comparative Example 2 | 0.05 | 0.70 | — | 1.22 |

Examples 11–13

The same procedure as in Example 1 was repeated, except that compounds 97, 103 and 110 were respectively used in Examples 11–13 instead of compound 1 to obtain heat-sensitive recording materials and evaluate them. The results are shown in Table 3.

TABLE 3

| | Optical density | | | |
|---|---|---|---|---|
| | Unprinted portion | Printed portion 0.5 ms | 0.6 ms | 0.7 ms |
| Example 11 | 0.04 | — | 1.11 | — |
| Example 12 | 0.05 | — | 1.07 | — |
| Example 13 | 0.05 | — | 1.13 | — |
| Comparative Example 1 | 0.05 | — | 0.62 | — |
| Comparative Example 2 | 0.05 | — | 0.97 | — |

Examples 14–19

The same procedure as in Example 1 was repeated, except that the following compounds were used instead of compound 1 to obtain heat-sensitive recording materials and evaluate them.

| | |
|---|---|
| Example 14: | compound 129 |
| Example 15: | compound 143 |
| Example 16: | compound 157 |
| Example 17: | compound 167 |
| Example 18: | compound 174 |
| Example 19: | compound 175 |

The results are shown in Table 4.

TABLE 4

| | Optical density | | | |
|---|---|---|---|---|
| | Unprinted portion | Printed portion 0.5 ms | 0.6 ms | 0.7 ms |
| Example 14 | 0.06 | 0.76 | — | 1.21 |
| Example 15 | 0.06 | 0.84 | — | 1.28 |
| Example 16 | 0.06 | 0.82 | — | 1.20 |
| Example 17 | 0.06 | 0.79 | — | 1.25 |
| Example 18 | 0.06 | 0.79 | — | 1.29 |
| Example 19 | 0.06 | 0.84 | — | 1.34 |
| Comparative Example 1 | 0.06 | 0.40 | — | 0.71 |
| Comparative Example 2 | 0.06 | 0.61 | — | 1.15 |

Examples 20–23

The same procedure as in Example 1 was repeated, except that the following compounds were used instead of compound 1 to obtain heat-sensitive recording materials and evaluate them.

| | |
|---|---|
| Example 20: | compound 177 |

-continued

| | |
|---|---|
| Example 21: | compound 178 |
| Example 22: | compound 179 |
| Example 23: | compound 182 |

The results are shown in Table 5.

TABLE 5

| | Optical density | | | |
|---|---|---|---|---|
| | Unprinted portion | Printed portion 0.5 ms | 0.6 ms | 0.7 ms |
| Example 20 | 0.06 | 0.93 | — | 1.31 |
| Example 21 | 0.05 | 0.77 | — | 1.30 |
| Example 22 | 0.05 | 0.68 | — | 1.30 |
| Example 23 | 0.05 | 0.75 | — | 1.25 |
| Comparative Example 1 | 0.06 | 0.40 | — | 0.71 |
| Comparative Example 2 | 0.06 | 0.61 | — | 1.15 |

Examples 24–30

The same procedure as in Example 1 was repeated, except that the following compounds were used instead of compound 1 to obtain heat-sensitive recording materials and evaluate them.

| | |
|---|---|
| Example 24: | compound 190 |
| Example 25: | compound 196 |
| Example 26: | compound 197 |
| Example 27: | compound 198 |
| Example 28: | compound 200 |
| Example 29: | compound 205 |
| Example 30: | compound 271 |

The results are shown in Table 6.

TABLE 6

| | Optical density | | | |
|---|---|---|---|---|
| | Unprinted portion | Printed portion 0.5 ms | 0.6 ms | 0.7 ms |
| Example 24 | 0.05 | 1.02 | — | 1.35 |
| Example 25 | 0.05 | 0.68 | — | 1.23 |
| Example 26 | 0.05 | 0.79 | — | 1.32 |
| Example 27 | 0.05 | 0.86 | — | 1.36 |
| Example 28 | 0.05 | 0.98 | — | 1.38 |
| Example 29 | 0.05 | 0.84 | — | 1.40 |
| Example 30 | 0.05 | 0.92 | — | 1.40 |
| Comparative Example 1 | 0.05 | 0.40 | — | 0.71 |
| Comparative Example 2 | 0.06 | 0.61 | — | 1.15 |

Examples 31–37

The same procedure as in Example 1 was repeated, except that the following compounds were used instead of compound 1 to obtain heat-sensitive recording materials and evaluate them.

| | |
|---|---|
| Example 31: | compound 277 |
| Example 32: | compound 278 |
| Example 33: | compound 279 |
| Example 34: | compound 280 |
| Example 35: | compound 284 |
| Example 36: | compound 294 |
| Example 37: | compound 317 |

The results are shown in Table 7.

TABLE 7

| | Optical density | | | |
|---|---|---|---|---|
| | Unprinted portion | Printed portion | | |
| | | 0.5 ms | 0.6 ms | 0.7 ms |
| Example 31 | 0.06 | 0.73 | — | 1.29 |
| Example 32 | 0.06 | 0.81 | — | 1.31 |
| Example 33 | 0.06 | 0.78 | — | 1.30 |
| Example 34 | 0.06 | 0.72 | — | 1.29 |
| Example 35 | 0.06 | 0.87 | — | 1.33 |
| Example 36 | 0.06 | 0.66 | — | 1.26 |
| Example 37 | 0.06 | 0.66 | — | 1.27 |
| Comparative Example 1 | 0.06 | 0.40 | — | 0.71 |
| Comparative Example 2 | 0.06 | 0.61 | — | 1.15 |

Examples 38–42

The same procedure as in Example 1 was repeated, except that the following compounds were used instead of compound 1 to obtain heat-sensitive recording materials and evaluate them.

| | |
|---|---|
| Example 38: | compound 319 |
| Example 39: | compound 320 |
| Example 40: | compound 331 |
| Example 41: | compound 335 |
| Example 42: | compound 341 |

The results are shown in Table 8.

TABLE 8

| | Optical density | | | |
|---|---|---|---|---|
| | Unprinted portion | Printed portion | | |
| | | 0.5 ms | 0.6 ms | 0.7 ms |
| Example 38 | 0.05 | 0.83 | — | 1.31 |
| Example 39 | 0.05 | 0.79 | — | 1.34 |
| Example 40 | 0.05 | 0.75 | — | 1.29 |
| Example 41 | 0.05 | 0.94 | — | 1.38 |
| Example 42 | 0.05 | 0.89 | — | 1.34 |
| Comparative Example 1 | 0.05 | 0.40 | — | 0.71 |
| Comparative Example 2 | 0.06 | 0.61 | — | 1.15 |

As is clear from these results, according to this invention, there can be obtained heat-sensitive recording materials which is excellent in heat responsiveness, and hence gives recorded images having a sufficient optical density even when printing is effected with low energy.

What is claimed is:

1. A heat-sensitive recording material comprising a support and a heat-sensitive recording layer provided on the support, said heat-sensitive recording layer comprising an electron-donating, colorless or pale-colored dye precursor, an electron-accepting developer which reacts with the dye precursor to form images upon heating, a binder, and an aromatic compound represented by the following structural formula:

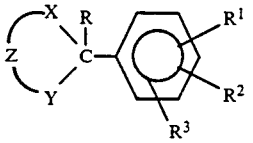

wherein

X and Y are oxygen atoms or sulfur atoms and may or may not be identical with each other, Z is alkylene group which has two or more carbon atoms and may have a side chain, R is hydrogen atom or alkyl group, $R^1$, $R^2$ and $R^3$ are independently hydrogen atoms;

alkoxy groups;

alkylthio groups;

phenyl groups;

aryloxy groups which may have a substituent;

—$COOR^4$ groups wherein $R^4$ is alkyl group or aralkyl or aryl group which may have a substituent; or —$OZ^1X^1$—$Ar^1$ groups wherein $Z^1$ is alkylene or alkenylene group which may have a substituent, $X^1$ is oxygen atom, sulfur atom or single bond, and $Ar^1$ is aryl group which may have a substituent;

and wherein all of $R^1$, $R^2$ and $R^3$ are not hydrogen atoms and two of $R^1$, $R^2$ and $R^3$ may be linked with each other to form a cyclic structure.

2. A heat-sensitive recording material according to claim 1, wherein $R^1$ and $R^2$ are hydrogen atoms, $R^3$ is —$OZ^1X^1$—$Ar^1$ group wherein $Z^1$ is alkylene group having 1–4 carbon atoms, and $X^1$ is oxygen atom or a single bond.

3. A heat sensitive recording material according to claim 2, wherein $Z^1$ is methylene group or ethylene group.

4. A heat-sensitive recording material according to claim 3, wherein $R^3$ bonds to 4-position of the benzene ring.

5. A heat-sensitive recording material according to claim 4, wherein Z is ethylene group and R is hydrogen atom or methyl group.

6. A heat-sensitive recording material according to claim 1, wherein R, $R^1$ and $R^2$ are hydrogen atoms, $R^3$ is —$OZ^1X^1$—$Ar^1$ group bonding to 4-position of the benzene ring wherein $X^1$ is a single bond and $Z^1$ is a methylene group.

7. A heat-sensitive recording material according to claim 1, wherein R, $R^1$ and $R^2$ are hydrogen atoms, and $R^3$ is phenyl group bonding to 4-position of the benzene ring.

8. A heat-sensitive recording material according to claim 1, wherein R, $R^1$ and $R^2$ are hydrogen atoms, $R^3$ is —$COOR^4$ group.

9. A heat-sensitive recording material according to claim 1, wherein R is hydrogen atom and $R^3$ bonds to other than 4-position of the benzene ring when $R^1$ and $R^2$ are hydrogen atoms.

10. A heat-sensitive recording material according to claim 1, wherein $R^2$ are hydrogen atoms and $R^3$ is aryloxy group which may have a substituent.

11. A heat-sensitive recording material according to claim 1, wherein $R^1$ and $R^2$ are hydrogen atoms $R^3$ is —$OZ^1X^1$—$Ar^1$ group.

12. A heat-sensitive recording material according to claim 1, wherein R is an alkyl group, and $R^l$, $R^2$ and $R^3$ are independently hydrogen atoms, alkoxy groups, or aralkyloxy or aralkenyloxy groups which may have a substituent.

13. A heat-sensitive recording material according to claim 1, wherein R, $R^1$ and $R^2$ are hydrogen atoms and $R^3$ is —$OZ^1X^1$—$Ar^1$ group wherein $X^1$ is a single bond.

14. A heat-sensitive recording material according to claim 1, wherein the developer is contained in an amount of 5–400% by weight based on the weight of the dye precursor.

15. A heat-sensitive recording material according to claim 1, wherein the developer is contained in an amount of 20–300% by weight based on the weight of the dye precursor.

16. A heat-sensitive recording material according to claim 1, wherein the aromatic compound is contained in an amount of 5–400% by weight based on the weight of the developer.

17. A heat-sensitive recording material according to claim 1, wherein the aromatic compound is contained in an amount of 20–300% by weight based on the weight of the developer.

* * * * *